US008740586B2

(12) United States Patent
Martinez et al.

(10) Patent No.: US 8,740,586 B2
(45) Date of Patent: Jun. 3, 2014

(54) HEAT EXCHANGER FOR ESP MOTOR

(75) Inventors: Ignacio Martinez, Rio de Janeiro (BR); Dan A. Merrill, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 238 days.

(21) Appl. No.: 12/825,141

(22) Filed: Jun. 28, 2010

(65) Prior Publication Data

US 2010/0329908 A1 Dec. 30, 2010

Related U.S. Application Data

(60) Provisional application No. 61/221,451, filed on Jun. 29, 2009.

(51) Int. Cl.
*F04D 13/08* (2006.01)

(52) U.S. Cl.
USPC ..... 417/423.3; 417/423.8; 417/367; 417/53; 310/54; 310/87; 166/62

(58) Field of Classification Search
CPC ..... F04D 13/086; F04D 29/588; F04D 13/08; F04D 13/0653; H02K 5/132; H02K 9/19
USPC ..... 417/423.3, 423.8, 367, 53; 310/54, 87; 166/62, 60, 302, 105, 68
See application file for complete search history.

(56) References Cited

U.S. PATENT DOCUMENTS

| | | | | |
|---|---|---|---|---|
| 2,556,435 | A | 6/1951 | Moehrl et al. | |
| 2,735,026 | A * | 2/1956 | Moerk | 310/54 |
| 2,951,165 | A * | 8/1960 | Arutunoff | 310/54 |
| 3,242,360 | A | 3/1966 | Carle | |
| 3,487,784 | A * | 1/1970 | Rafferty et al. | 415/119 |
| 3,671,786 | A | 6/1972 | Jones | |
| 4,126,406 | A * | 11/1978 | Traylor et al. | 417/373 |
| 4,286,185 | A | 8/1981 | Erickson | |
| 4,436,488 | A * | 3/1984 | Witten | 417/53 |
| 4,685,867 | A | 8/1987 | Patun et al. | |
| 5,154,741 | A * | 10/1992 | da Costa Filho | 96/157 |
| 5,939,808 | A * | 8/1999 | Adames | 310/89 |
| 5,961,282 | A * | 10/1999 | Wittrisch et al. | 415/199.6 |
| 6,059,539 | A * | 5/2000 | Nyilas et al. | 417/228 |
| 6,688,392 | B2 * | 2/2004 | Shaw | 166/366 |
| 7,481,270 | B2 * | 1/2009 | Shepler | 166/105 |

(Continued)

OTHER PUBLICATIONS

One sheet from a brochure of Byron Jackson identified as Bulletin No. 2560-6A, brochure published in the 1990s (unknown specific date).*

(Continued)

*Primary Examiner* — Devon Kramer
*Assistant Examiner* — Joseph Herrmann
(74) *Attorney, Agent, or Firm* — Bracewell & Giuliani LLP

(57) ABSTRACT

A heat exchanger to serve ESP equipment installed on the seabed located in either a caisson or skid. A hot oil line connects the base of the ESP motor with the externally located heat exchanger, allowing hot motor oil to be circulated through coils externally exposed to seawater. The heat from the oil is rejected to the seawater and the cooled oil is reintroduced to the motor via a cold oil line that communicates with the seal section. The heat exchanger arrangement reduces the temperature of an ESP motor, thus allowing the motor to operate longer and more reliably.

13 Claims, 4 Drawing Sheets

(56) References Cited

U.S. PATENT DOCUMENTS

| | | | | |
|---|---|---|---|---|
| 7,492,069 | B2 | 2/2009 | Knox et al. | |
| 7,914,266 | B2 * | 3/2011 | Kerr et al. | 417/410.1 |
| 8,037,936 | B2 | 10/2011 | Neuroth et al. | |
| 2005/0220645 | A1 * | 10/2005 | Kerr et al. | 417/555.1 |
| 2009/0232664 | A1 * | 9/2009 | Qu et al. | 417/44.1 |
| 2009/0269224 | A1 | 10/2009 | Hunt et al. | |
| 2010/0119380 | A1 * | 5/2010 | Wilson et al. | 417/53 |

OTHER PUBLICATIONS

One sheet from a brochure of Byron Jackson identified as Bulletin No. 2560-6A, brochure published in the 1990's (unknown specific date).

* cited by examiner

HEAT EXCHANGER FOR ESP MOTOR

CROSS-REFERENCE TO RELATED APPLICATION

This application claims priority to provisional application 61/221,451, filed Jun. 29, 2009, and is herein incorporated by reference in its entirety.

FIELD OF THE INVENTION

This invention relates in general to booster electric motors, and in particular to reducing the temperature of a sea floor submersible electric pump motor with a heat exchanger.

BACKGROUND OF THE INVENTION

Electrical submersible pumps ("ESP") are used for pumping high volumes of well fluid, particularly in wells requiring artificial lift. The ESP typically has at least one electrical motor that normally is a three-phase, AC motor. The motor drives a centrifugal pump that may contain a plurality of stages, each stage comprising an impeller and a diffuser that increases the pressure of the well fluid. The motor is filled with a dielectric lubricant or oil that provides lubrication and aids in the removal of heat from the motor during operation of the ESP. A seal section is typically located between the pump and the motor for equalizing the pressure of the lubricant contained within the motor with the hydrostatic pressure of the well fluid on the exterior. The seal section is filled with oil that communicates with the oil in the motor.

The ESP is typically run within the well with a workover rig. The ESP is run on the lower end of a string of production tubing. Once in place, the ESP may be energized to begin producing well fluid that is discharged into the production string for pumping to the surface.

During operation, the temperature of the oil in the motor of the ESP increases due to mechanical friction and electrical efficiency in the motor. Internal motor temperature is dissipated thru the stator to the housing of the motor to the produced (pumped) fluid. Higher fluid velocity around the motor, or lower fluid temperature, can lead to increased heat removal from the motor. The internal oil has lubricant properties and in some way helps dissipate the heat from internals of the motor through heat transfer, but its effect is limited. One of the most important properties of the oil is to lubricate the bearings of the motor. The oil is also vital in dissipating heat from the bearings and thrust load bearings as well as in maintaining the motor within its rated temperature, and maintaining reliability. However, rejection of heat from the oil to the surrounding well fluid is usually limited due to the well fluid's high temperature, and also poor heat transfer characteristics due to high viscosity. The increased temperature of the motor oil may lead to low performance or premature failure of the motor.

A technique is desired to improve motor cooling by circulating oil or lubricant out of the motor to cool down the motor temperature. Thus allowing the motor to operate at a lower temperature that may translate to extended life and increased reliability of the motor.

SUMMARY OF THE INVENTION

In the present disclosure, an ESP is described that is part of a boosting system located on the seabed. The ESP may be horizontally mounted, inclined, or vertically mounted on a skid or within a caisson in the seafloor. The ESP has at least one motor and at least one pump, with a seal section located in between.

A heat exchanger is located external to the ESP boosting system and has an inlet port and an outlet port. An oil line connects to the inlet port of the heat exchanger and communicates with the motor. Another oil line connects to the outlet port of the heat exchanger and communicates with the ESP. To circulate the hot motor oil from the motor to the heat exchanger, a pump is located within the ESP system. The hot motor oil is circulated through the inlet oil line to the heat exchanger where heat is rejected to the surrounding seawater. The cooled oil is then returned to the ESP via the oil line connected to the outlet port of the heat exchanger. The cooled oil is then reintroduced to the motor. The ESP boosting system may be located within a capsule and the arrangement of the ESP may be conventional or inverted.

The heat exchanger arrangement reduces the temperature of the motor oil to thereby cool the motor more effectively. Thus, the life of the motor is advantageously extended and its reliability is advantageously increased.

DETAILED DESCRIPTION OF THE INVENTION

Figure 1:
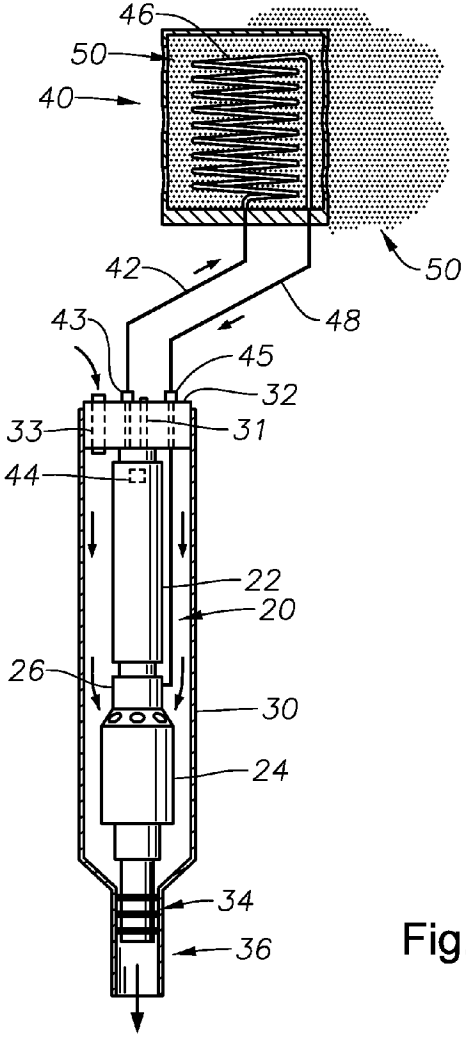
FIG. 1 is a sectional view of an electrical submersible pump with a heat exchanger, in accordance with an embodiment of the invention.

Referring to FIG. 1, an electrical submersible pump ("ESP") 20 is illustrated in a sectional view. The ESP 20 can be part of a boosting system located on the seabed. It may be horizontally mounted, inclined, or vertically mounted with a caisson in the seafloor. A motor 22 and pump 24 are shown with a seal section 26 located in between. The seal section 26 contains a thrust bearing and a pressure equalizer to equalize the pressure of lubricant in the motor 22 with the hydrostatic pressure.

Figure 4:
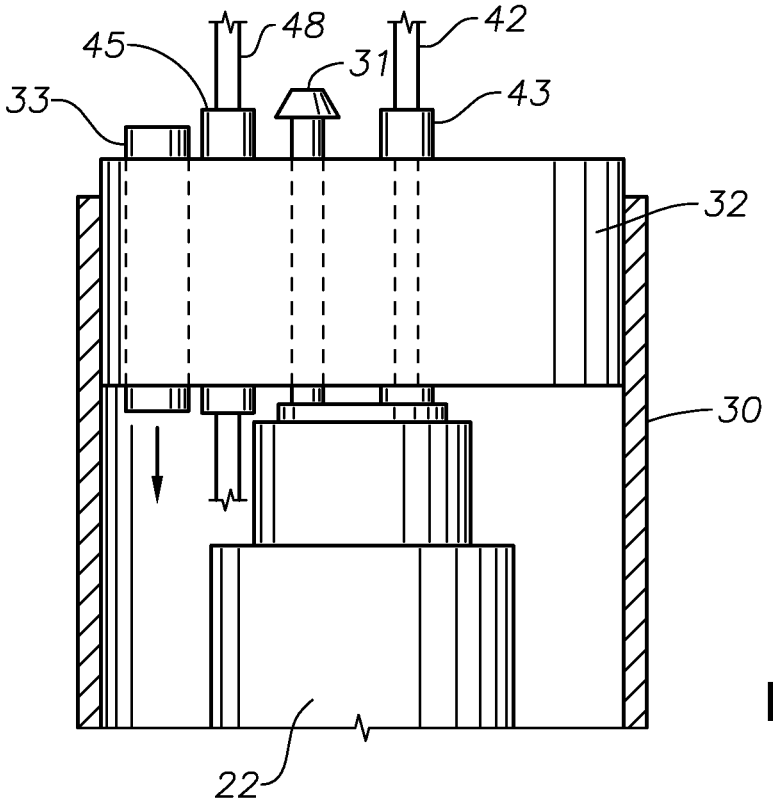
FIGS. 4 and 5 show a typical motor electrical connector and oil line connector arrangement, in accordance with an embodiment of the invention.
Figure 5:
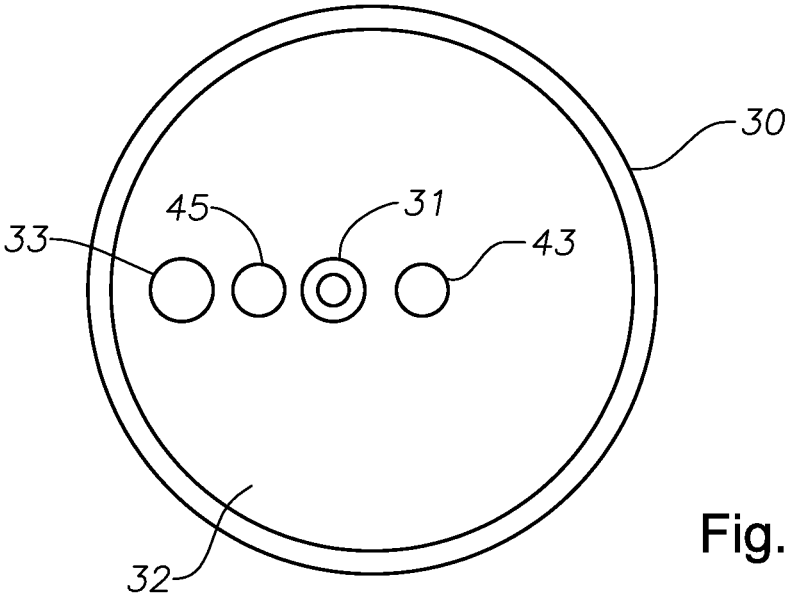

A capsule 30 houses the ESP 20 and has a cap or barrier 32 at one end and a discharge port 36 at the other end. Capsule 30 in this example is located on the sea floor and is horizontal or inclined on a skid. The cap 32 can have various types of ports and connections depending on the configuration of the ESP within the capsule 30. In this example, the motor 22 and pump 24 are in the inverted position such that the base of the motor 22 faces the end of the capsule 30 with the cap 32. A standard subsea connector 31 that passes thru the cap 32 can thus be used to connect with the base of the motor 22 as shown in FIGS. 4 and 5. A power umbilical (not shown) can then provide electrical power to the motor 22 via the subsea connector 31.

In this example, a port 33 passes thru the cap 32 to allow production fluid to flow into the capsule 30. Port 33 can connect to a flow line coming directly from a well or from other subsea equipment. The fluid is discharged by the pump 24 thru port 36. The discharge end of the pump 24 has a seal assembly 34 that seals the discharge end from the capsule 30. In this example, port 36 can connect to a production flow line or to a production riser that can move production fluid to, for example, a floating production storage and offloading unit, a tension leg platform, a fixed platform, or a land facility. Alternatively, the seal section 26 could be replaced by a battery of mechanical seals.

Continuing to refer to FIG. 1, during operation of the ESP 20, the temperature of the motor oil inside the motor 22 and circulating through the seal section 26 rises. Reducing the temperature of the motor oil to thereby cool the motor 22 advantageously extends the life and increases the reliability of the motor 22. A heat exchanger 40 can be located on the seabed externally to the capsule 30 or on a skid that supports capsule 30 to cool the motor oil. A hot oil line 42 passes thru a connector 43 that passes thru the cap 32 to allow the hot oil line 42 to communicate with the base of the motor 22. The hot oil line 42 allows hot motor oil from the base of the motor 22 to be circulated to the heat exchanger 40. Once inside the heat exchanger 40, the hot oil is circulated through coils 46 externally exposed to the seawater 50. The heat from the oil is thus rejected to the seawater 50 and the cooled oil is reintroduced to the motor 22 via a cold oil line 48. The cold oil line 48 passes thru a connector 45 and communicates with the seal section 26. In this example, an oil pump 44 is located inside and at the base of the motor 22. The oil pump 44 is driven by a shaft in the motor 22 and circulates the oil in the loop formed by the motor 22 and the heat exchanger 40. The motor 22 thus operates at a cooler temperature and can operate longer and more reliably.

Figure 2:
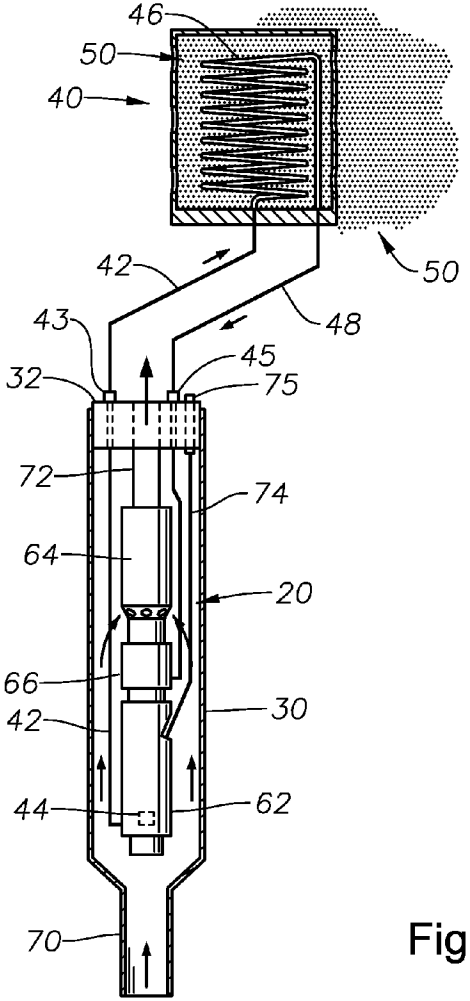
FIG. 2 is an alternative embodiment of the embodiment of FIG. 1.
Figure 6:
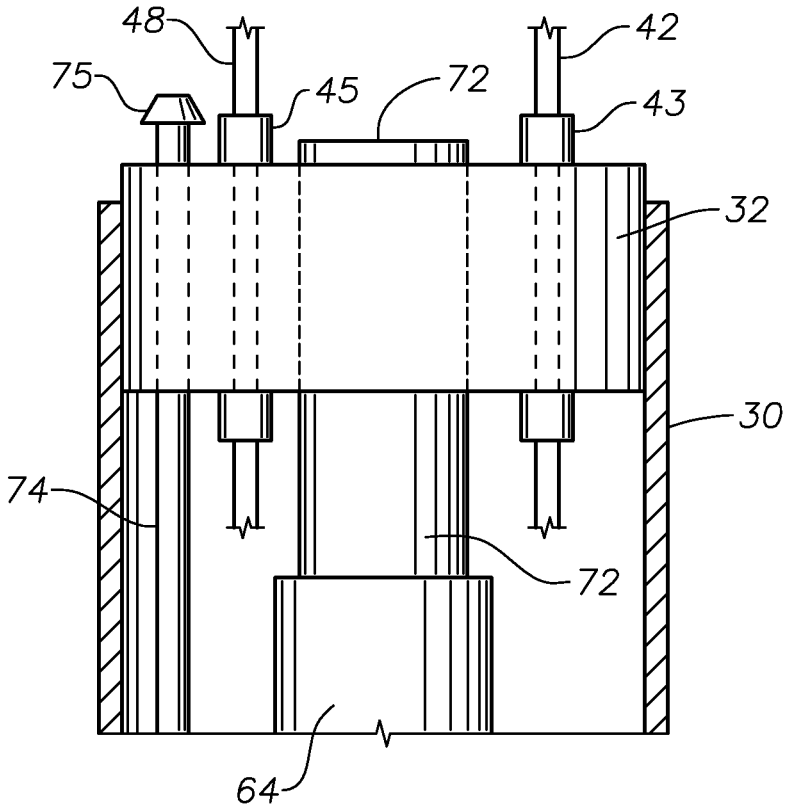
FIGS. 6 and 7 show a typical electrical penetrator and oil line connector arrangement, in accordance with an embodiment of the invention.
Figure 7:
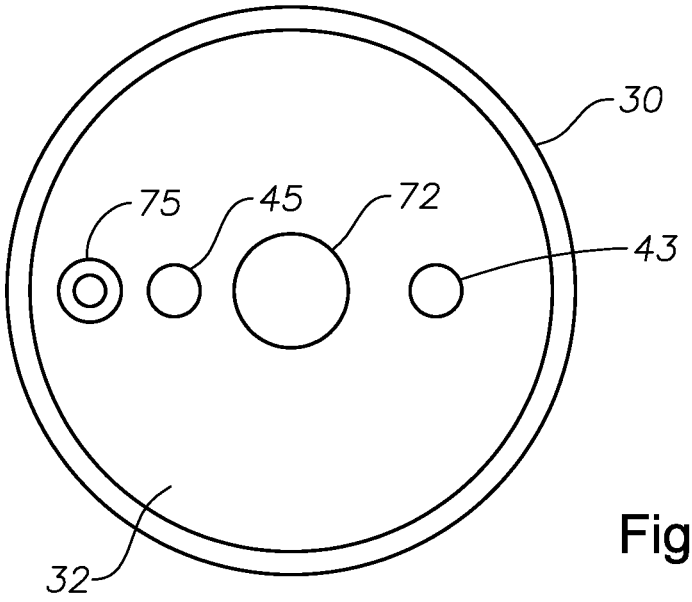

Referring to FIG. 2, an alternative embodiment is illustrated that is similar to the embodiment shown in FIG. 1. However, in this embodiment, the ESP 20 uses a standard ESP arrangement instead of an inverted arrangement. Thus, the motor 62 is located below the pump 64 and a seal section 66 is located between. Further, the production fluid will flow into the capsule 30 through a port 70 at one end of the capsule 30. Port 70 connects to a flow line carrying production fluid from a well. The pump 64 discharges the production fluid through a piece of tubing 72 that passes through the cap 32. The discharge tubing 72 can connect to a flow line or riser, as in the embodiment of FIG. 1. The base of the motor 62 in this example is at the end of the capsule 30 opposite the cap 32. A power cable 74 runs through an electrical penetrator 75 in the cap 32 (FIGS. 6 and 7) and connects to motor 62 to energize it. The hot oil line 42 extends down into the capsule to communicate with the base of the motor 62 and the cold oil line 48 returns the cooled oil from the heat exchanger 40 to the seal section 66. As in the embodiment in FIG. 1, the oil pump 44 circulates the oil in the loop formed by the motor 62 and the heat exchanger 40.

Figure 3:
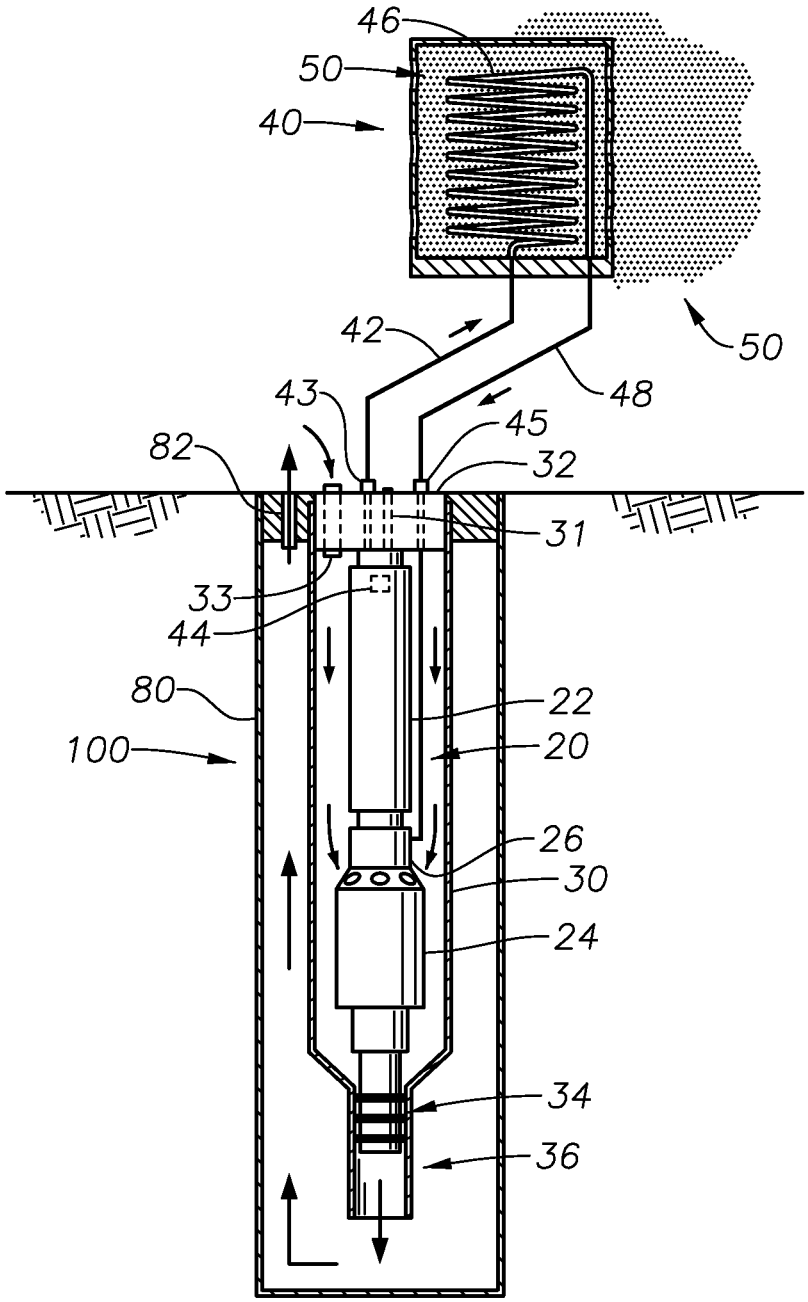
FIG. 3 is an alternative embodiment of the embodiment of FIG. 1.

In another embodiment, the capsule 30 and the ESP 20 within can be housed in a caisson 80 as shown in FIG. 3. The caisson 80 can be partially or completely submerged in the seabed and can be several hundred feet deep. The connections and ESP 20 arrangement are identical in this embodiment to those shown in the embodiment of FIG. 1. However, the pump 24 discharges production fluid from the capsule 30 through outlet 36 and into the caisson 80 instead of a production flow line. An outlet port 80 on the caisson 80 connects to a production fluid riser or flow line. The caisson 80 can be used to separate gas in the production fluid to thereby increase pumping efficiency. If so, the well fluid would flow into the top of the caisson, then down to an open bolter end of the capsule. The well fluid would flow up the capsule and be discharged by the pump from the upper end of the capsule. The heat exchanger 40 would be located proximate and external the caisson 80 to cool the motor oil. Alternatively, the ESP 20 may be housed within the caisson 80 in a standard ESP arrangement such as that shown in FIG. 2.

During operation of an ESP 20, the heat generated in the motor raises the temperature of the motor oil. The hot motor oil becomes less effective at cooling the motor. The motor can thus become less reliable and must be replaced if it fails prematurely. By circulating the motor oil through a heat exchanger to cool the oil, the cooled oil can then be reintroduced into the motor. The cooled motor oil allows the motor to advantageously operate at a lower temperature, thus extending the life and increasing the reliability of the motor.

While the invention has been shown in only one of its forms, it should be apparent to those skilled in the art that it is not so limited but is susceptible to various changes without departing from the scope of the invention.

What is claimed is:

1. A method for cooling a motor for use in an electrical submersible subsea booster pumping system, the method comprising:

positioning a conduit having first and second ends subsea;

mounting a submersible pump assembly in the conduit, the pump assembly having a centrifugal pump, an electrical motor, and a seal section connected between the pump and the motor, the motor being filled with a dielectric lubricant;

connecting a cap to one of the ends of the conduit;

providing a submerged heat exchanger external of the conduit in a vicinity of the sea floor, the heat exchanger having an inlet port and an outlet port;

connecting a dielectric lubricant inlet line to the inlet port of the heat exchanger, extending the inlet line sealingly through the cap to the submersible pump assembly in fluid communication with the dielectric lubricant in the motor;

connecting a dielectric lubricant outlet line to the outlet port of the heat exchanger, extending the outlet line sealingly through the cap to the submersible pump assembly in fluid communication with the dielectric lubricant in the motor;

flowing production fluid into one of the ends of the conduit and operating the motor, causing the pump to pump production fluid out the other of the ends of the conduit which is connected to a production flow line or riser;

circulating the dielectric lubricant from within the motor through the inlet line to the inlet port of the heat exchanger;

removing heat from the dielectric lubricant at the heat exchanger by exchanging the heat with seawater to thereby reduce the temperature of the dielectric lubricant;

circulating the dielectric lubricant from the outlet of the heat exchanger through the outlet line into the motor; and with the seal section, reducing a pressure differential between the dielectric lubricant in the motor the hydrostatic pressure of the production fluid in the conduit outside the motor.

2. The method of claim 1, wherein circulating the dielectric lubricant comprises pumping the dielectric lubricant from the motor to the inlet port of the heat exchanger.

3. The method of claim 2, wherein pumping the dielectric lubricant comprises locating a dielectric lubricant pump in an interior of the motor and coupling the dielectric lubricant pump to a shaft driven by the motor.

4. The method of claim 2, wherein pumping the dielectric lubricant further comprises driving a dielectric lubricant pump with the motor.

5. The method of claim 1, wherein:

connecting the dielectric lubricant outlet line to the submersible pump assembly comprises connecting the dielectric lubricant outlet line to the seal section; and connecting the dielectric lubricant inlet line to the submersible pump assembly comprises connecting the dielectric lubricant inlet line to the motor.

6. The method of claim 1, wherein the step of removing the heat from the dielectric lubricant comprises circulating dielectric lubricant through a coiled tube in a housing of the heat exchanger, the coiled tube being immersed in the seawater.

7. A subsea electrical submersible booster pumping system, comprising:

a conduit adapted to be positioned subsea and having first and second ends, the conduit having an interior sealed from sea water;

an inlet on the first end for admitting production fluid into an interior of the conduit;

a submersible pump assembly mounted in the conduit for immersion in the production fluid, the submersible pump assembly including a centrifugal pump having an intake in fluid communication with the production fluid in the interior of the conduit, the centrifugal pump having an outlet on the second end which is connected to a production flow line or riser for discharging the production fluid;

the submersible pump assembly including a subsea electrical motor mounted in the conduit for immersion in the production fluid, the motor being filled with a dielectric lubricant;

a seal section connected between the centrifugal pump and the motor for reducing a pressure differential between the dielectric lubricant in the motor and the production fluid surrounding the seal section;

a heat exchanger exterior of and adjacent the conduit, having an inlet port and an outlet port and immersed in seawater;

a cap sealingly secured to one of the ends of the conduit;

an inlet dielectric lubricant line extending sealingly through the cap into the conduit in communication with the dielectric lubricant in the motor and connected to the inlet port of the heat exchanger;

an outlet dielectric lubricant line extending sealingly through the cap into the conduit in communication with the dielectric lubricant in the motor and connected to the outlet port of the heat exchanger; and a dielectric lubricant pump within the motor for circulating the dielectric lubricant through the lubricant lines and the heat exchanger.

8. The system of claim 7, wherein the lubricant lines extend alongside at least part of the submersible pump assembly.

9. The system of claim 7, wherein the heat exchanger, the lubricant lines and an interior of the motor comprise a closed sealed loop for the dielectric lubricant.

10. The system of claim 9, wherein the motor is located between the inlet at the first end of the conduit and the intake of the centrifugal pump so that the production fluid flowing from the inlet to the intake flows around the motor.

11. The system of claim 7, wherein one of the dielectric lubricant lines is connected to the seal section and the other of the dielectric lubricant lines is connected to the motor at an end of the motor opposite the seal section.

12. A subsea booster pump system, comprising:

a subsea conduit having an interior sealed from sea water and first and second ends;

a production fluid inlet at one of the ends flowing production fluid into the interior of the conduit;

a centrifugal pump and electric motor located in the conduit for immersion in the production fluid in the interior of the conduit, the pump having an intake in fluid communication with the production fluid in the interior of the conduit, the pump having a discharge at the other end of the conduit which is connected to a flow line or riser for discharging the production fluid into the flow line or riser a seal section mounted between the pump and the motor that reduces a pressure differential between a dielectric fluid within the motor and a pressure of the production fluid within the interior of the conduit surrounding the seal section;

a heat exchanger located subsea exterior of and adjacent the conduit for immersion in sea water;

a cap on one of the ends of the conduit;

an inlet dielectric fluid line connected between the motor and the heat exchanger, the inlet dielectric fluid line extending sealingly through the cap into the conduit;

an outlet dielectric fluid line connected between the motor and the heat exchanger, the outlet dielectric fluid line extending sealingly through the cap into the conduit;

a dielectric fluid pump within the motor for circulating dielectric fluid through the inlet and outlet dielectric fluid lines between the motor and the heat exchanger;

the heat exchanger having a tube connected between the inlet and outlet dielectric fluid lines, the tube being immersed in seawater to cool the dielectric fluid flowing therethrough.

13. The subsea booster pump system of claim 12, wherein the tube of the heat exchanger is coiled and is located within a heat exchanger housing having an opening to admit seawater.

* * * * *

UNITED STATES PATENT AND TRADEMARK OFFICE

CERTIFICATE OF CORRECTION

PATENT NO. : 8,740,586 B2
APPLICATION NO. : 12/825141
DATED : June 3, 2014
INVENTOR(S) : Ignacio Martinez et al.

It is certified that error appears in the above-identified patent and that said Letters Patent is hereby corrected as shown below:

In the Specification
Column 1, line 40, delete “efficiency” and insert --inefficiency--
Column 1, line 41, delete “thru” and insert --through--
Column 2, line 58, delete “thru” and insert --through--
Column 2, line 63, delete “thru” and insert --through--
Column 2, line 67, delete “thru” and insert --through--
Column 3, line 15, delete “thru” and insert --through--
Column 3, line 16, delete “thru” and insert --through--
Column 3, line 64, delete “bolter” and insert --bottom--
Column 3, line 24, delete “thru” and insert --through--

In the Claims
Column 4, line 58, Claim 1, after “motor” insert --and--

Signed and Sealed this
Ninth Day of December, 2014

Michelle K. Lee

Michelle K. Lee
*Deputy Director of the United States Patent and Trademark Office*